US005974998A

United States Patent [19]

Gregg, III

[11] Patent Number: 5,974,998

[45] Date of Patent: Nov. 2, 1999

[54] APPARATUS FOR FOILING BIRD LANDINGS

[76] Inventor: William C. Gregg, III, 6 Winston Dr., Belleair, Fla. 33756

[21] Appl. No.: 09/211,624

[22] Filed: Dec. 15, 1998

[51] Int. Cl.[6] ..... B63B 15/00

[52] U.S. Cl. ..... 114/90; 52/101; 256/11; 119/903

[58] Field of Search ..... 114/89, 90, 343; 52/101; 256/11; 119/72.5, 903; 441/1, 16, 17

[56] References Cited

U.S. PATENT DOCUMENTS

| | | | |
|---|---|---|---|
| 3,292,319 | 12/1966 | McCarthy | 52/101 |
| 4,074,653 | 2/1978 | Pember | 116/22 A |
| 4,748,778 | 6/1988 | Rafter, Sr. | 52/101 |

*Primary Examiner*—Jesus D. Sotelo
*Attorney, Agent, or Firm*—Ronald E. Smith

[57] ABSTRACT

A device that prevents birds from landing atop a masthead of a boat or wind indicating devices mounted on the masthead includes an upstanding post having an upper end positioned above the top of the mast and any wind indicating devices. A plurality of rods radiate outwardly from the upper end in interfering relation to the landing area atop the masthead or wind indicating devices to foil landing attempts. The post is attached to a halyard and the device is raised in an inverted configuration when the halyard is raised. The device is also attached to a downhaul line so that when the device reaches the top of the mast, pulling on the downhaul line inverts the device and deploys it into its operative configuration. The radially disposed rods positioned in the landing area deprive birds of the clearance space they need when landing.

14 Claims, 2 Drawing Sheets

APPARATUS FOR FOILING BIRD LANDINGS

BACKGROUND OF THE INVENTION

1. Field of the Invention

This invention relates, generally, to devices that prevent birds from landing in preselected areas. More particularly, it relates to a device that surmounts a boat mast to prevent birds from alighting atop the mast.

2. Description of the Prior Art

The top of a boat mast is an attractive perch for most birds because it is high and isolated. Thus, birds feel protected from ground-based predators when perched atop a boat mast. Their droppings are unsightly, however, and require the boat owner to spend a lot of time cleaning up after a bird or birds has roosted on the mast. The problem is worse, of course, if the boat has been moored for an extended period of time. Unfortunately, the chemical composition of bird droppings is sometimes damaging to the finish of the boat, necessitating costly repair work.

Boat owners have tried mounting artificial owls, snakes, and other predators on or near the top of the mast, but the birds eventually realize the artificiality of such scarecrow devices and begin roosting on them, and the fouling of the boat resumes.

Inventors have developed several devices intended to keep birds from landing in preselected areas. Examples of such devices are disclosed in U.S. Pat. No. 3,292,319 to McCarthy and U.S. Pat. No. 4,074,653 to Pember, for example. However, these devices include rotating or flapping parts and thus require a motor, a source of power, relatively complex structural parts, and continual maintenance.

Thus, a need remains extent for a simple, maintenance-free apparatus having no moving parts, which consumes no power and that effectively foils bird landings on boat masts. The needed device would represent a permanent solution to the problem and would not be defeated once birds have become familiar with it.

However, it was not obvious to those of ordinary skill in this art how the needed improvements could be provided, in view of the art considered as a whole at the time the present invention was made.

SUMMARY OF THE INVENTION

The long-standing but heretofore unfulfilled need for an innovation that overcomes the limitations of the prior art is now met by a new, useful, and nonobvious invention that prevents birds from landing atop a boat mast. The novel apparatus includes a post having a first end and a second end and a plurality of rods that radiate from the post near the first end. The rods are disposed in radial relation to a longitudinal axis of the post. The first end of the post has an operable position adjacent an upper end of the masthead so that the rods are disposed in landing-interfering relation to the top of the masthead to prevent birds from landing thereatop by depriving them of the clearance space they require. The rods are also disposed in landing-interfering relation to the top of other objects, such as wind-measuring devices, which are commonly positioned near the masthead and upon which birds often land.

In a first embodiment, a plurality of throughbores is formed in the post near the first end thereof and one rod of the plurality of rods extends through each throughbore. Each rod is held in its throughbore about mid-length thereof so that substantially equal lengths of each rod are disposed in radial relation to the post on opposite sides thereof. Any number of rods may be used.

Alternatively, a hub member having a plurality of radiating bores formed therein is mounted on the post and a rod is positioned in each of the bores.

Each of the rods is preferably circular in transverse section and is made of a slightly compressible material. Each of the throughbores has a common uniform cylindrical internal diameter slightly less than a common external diameter of the rods so that each of the rods is held in its associated throughbore by a press fit.

In an alternative embodiment, each of the throughbores has a frusto-conical configuration where a large end thereof has a diameter greater than a common external diameter of the rods and where a small end thereof has a diameter that is slightly less than a common external diameter of the rods. Each of the rods is therefore held in its associated throughbore by a press fit.

In another alternative embodiment, an adhesive is used to secure the rods into their respective functional positions of adjustment and there is thus no reliance upon a press fit.

A first attachment means secures the post to a halyard so that raising the halyard raises the post to its operable position.

The first attachment means is, preferably, a loop member having a first end that loosely extends through a throughbore formed in the post at a preselected location between its first and second ends and having a second end secured to the halyard for conjoint movement therewith. The loop member may be attached by other means not requiring the formation of a throughbore in the post. For example, the loop member could be formed integrally with the post in a molding process and suitable hinge means, or no hinge means, could be provided.

A second attachment means secures the second end of the post to a downhaul line.

More particularly, the second attachment means is a loop member having a first end that loosely extends through a throughbore formed in the post adjacent the second end thereof and having a second end secured to the downhaul line. As with the first attachment means, the throughbore could be obviated and another suitable attachment means could be employed.

Since the rods make the novel apparatus top-heavy, it naturally assumes an inverted position when the first attachment means is secured to a halyard and the second attachment means is secured to a downhaul line. Accordingly, the apparatus is in an inverted position when raised by the halyard. After the inverted apparatus has been worked past standing rigging, spreaders or other obstacles which are mounted on the masthead or which are otherwise in the vicinity of the masthead, pulling on the downhaul line rights the apparatus from its inverted position, deploying it into its operable configuration. The flexibility and resiliency of the rods enables them to pass through constricted spaces around such obstacles and to re-deploy upon clearing the top of the masthead and nearby wind-measuring devices and the like.

It is a primary object of this invention to provide an apparatus for preventing birds of all types from alighting on the top of boat mastheads and nearby wind-measuring devices or the like.

A closely related object is to provide such an apparatus that continues to prevent bird landings even after birds have become familiar with it.

Another object is to provide a durable, maintenancefree device that is elegant in structure, economical to manufacture, easy to assemble, and affordable by boat owners.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
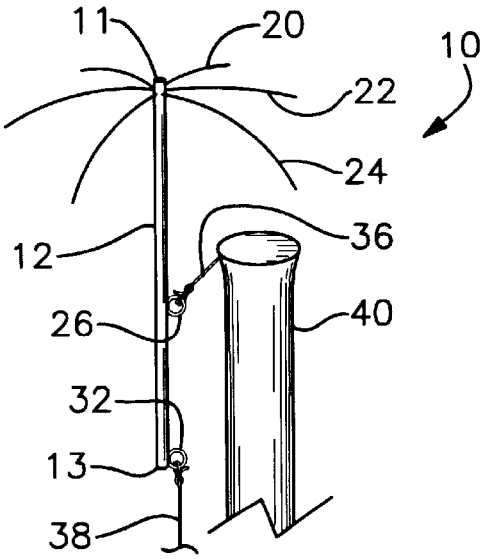
FIG. 1 is a perspective view of the novel device when fully deployed in its operable configuration.

Referring now to FIG. 1, it will there be seen that an exemplary embodiment of the invention is denoted as a whole by the reference numeral 10.

Apparatus 10 is made entirely of non-corrosive materials. It includes a post 12 having a first or upper end 11 and a second or lower end 13. Post 12 may be of solid or hollow construction and is preferably made of an elastomeric material such as nylon, polyvinylchloride, or other suitable material that exhibits flexibility, resilience, and resistance to ultraviolet rays.

Figure 2:
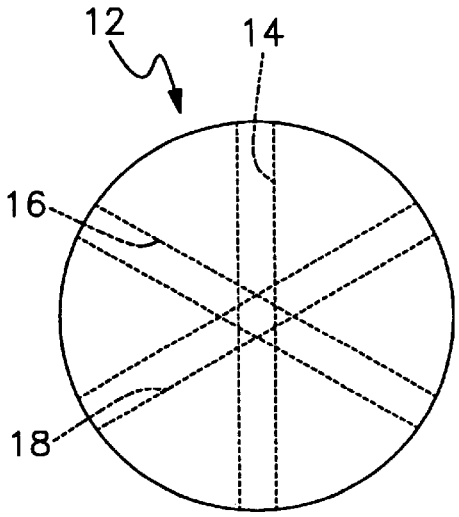
FIG. 2 is a top plan view of a first embodiment of the novel post where a first type of throughbore is formed therein.
Figure 3:
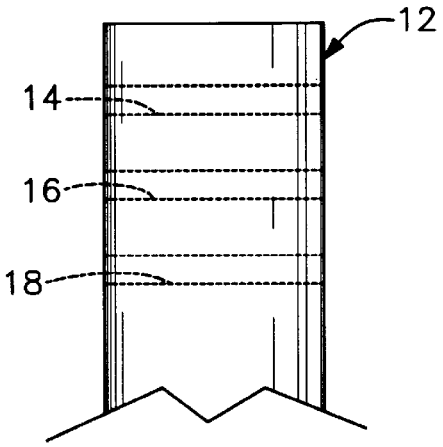
FIG. 3 is a side elevational view of the novel post.

As best understood in connection with FIGS. 2 and 3, a plurality of throughbores, denoted 14, 16 and 18, are formed in post 12 near upper end 11 thereof in a first embodiment of the invention. These throughbores collectively provide a first rod-mounting means. Each bore extends diametrically through post 12 as indicated in FIG. 2 and each bore is longitudinally spaced apart from its adjacent bore as indicated in FIG. 3 so that the bores do not intersect one another. The axis of each bore is normal to a longitudinal axis of post 12.

In the embodiment of FIGS. 2 and 3, the external diameter of each rod is slightly greater than the internal diameter of each bore and the rods are formed of a slightly compressible material to ensure a tight fit when the rods are slid into their respective bores. Bores 14, 16 and 18 of this embodiment have a uniform common diameter.

Figure 2A:
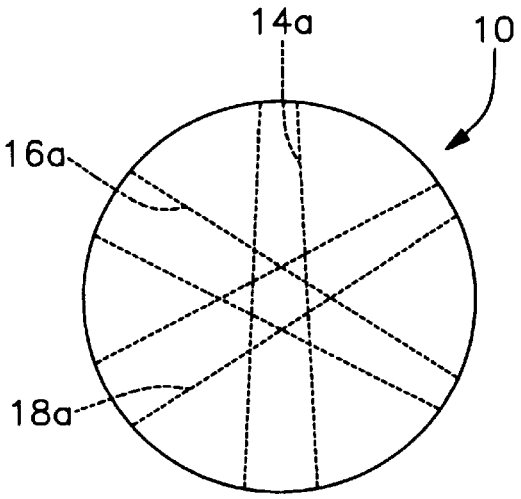
FIG. 2A is a top plan view of a second embodiment of the novel post where a second type of throughbore is formed therein.

In the embodiment of FIG. 2A, the bores are frusto-conical with the narrowest end thereof having a diameter smaller than the external diameter of the rods for the same reason; in said FIG. 2A, the frusto-conical bores are denoted 14*a,* 16*a* and 18*a*. Either way, the rods are easily slid into their respective bores and held therein at their respective midpoints by a press fit. An adhesive may be used to augment the press fit. The frusto-conical bores thus provide a second rod-mounting means.

The bores may also be provided with a larger diameter so that no press fit is attained. An adhesive may be used instead to hold the rods into their respective functional positions.

Figure 4:
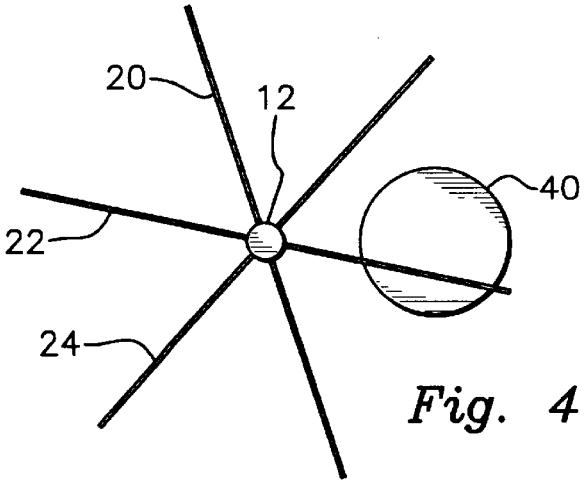
FIG. 4 is a top plan view depicting the device in its fully deployed configuration in its environment.

In FIGS. 1 and 4, the elongate rods that extend through the respective throughbores are denoted 20, 22 and 24. Each rod has a straight configuration and is preferably made of a flexible and resilient elastomeric material that is circular in transverse section. Accordingly, the rods may droop somewhat under the influence of gravity as depicted in FIG. 1. The cross section of the rods need not be circular.

Although the rods are depicted as being held by the respective throughbores at their respective mid-lengths so that the opposite ends of each rod are substantially equal in length, no such symmetrical mounting is required.

Figure 2B:
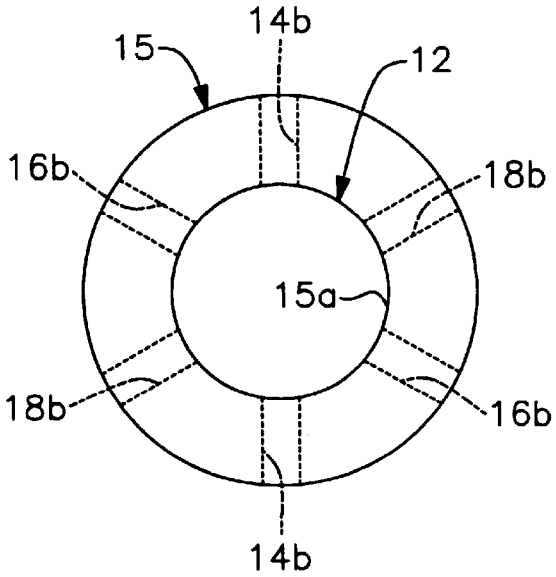
FIG. 2B is a top plan view of a third embodiment of the novel post where no throughbores are formed therein.

In a third embodiment, uniform diameter throughbores 14, 16 and 18 are obviated, as are frusto-conical throughbores 14*a,* 16*a* and 18*a,* i.e., post 12 is solid and has no throughbores or blind bores formed therein. As indicated in FIG. 2B, the rod-mounting means of this embodiment includes a centrally apertured hub member 15 secured to post 12 at upper end 11 thereof. More particularly, post 12 is securely received within a central aperture 15*a* formed in said hub. Plural bores, denoted 14*b,* 16*b* and 18*b,* are formed in hub 15 in radial relation to the longitudinal axis of post 12 and hence in radial relation to the longitudinal axis of said central aperture, and the respective radially innermost ends of the rods are securely received therewithin. Unlike the throughbores of the first two embodiments, all of the bores formed in hub 15 are coplanar with one another. The rods respectively received in bores 14*b,* 16*b* and 18*b* may have a common length or they may be of differing lengths.

Figure 2C:
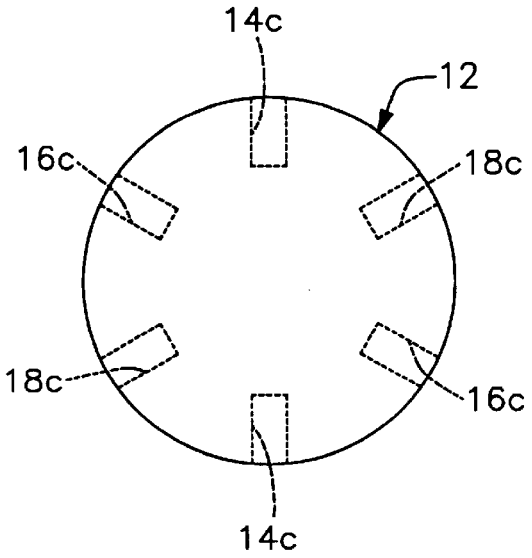
FIG. 2C is a top plan view of a fourth embodiment of the novel post where blind bores are substituted for the throughbores of the first two embodiments.

In a fourth embodiment, depicted in FIG. 2C, hub 15 is not used. Instead, the rod-mounting means includes plural blind bores 14*c,* 16*c* and 18*c* which are formed in the upper end of post 12 to receive the respective radially innermost ends of the rods. The blind bores are circumferentially but not necessarily equidistantly spaced apart from one another and may or may not be provided in co-planar relation to one another.

As indicated in FIG. 4, the radially outermost ends of rods 20, 22 and 24 are substantially equidistantly and circumferentially disposed with respect to one another.

Although the rods are depicted as having a common length and as being three in number (first two embodiments), or six in number (third and fourth embodiments), the respective lengths and the number of rods could vary. Three (or six) rods are depicted just to avoid cluttering the drawings. Where hub 15 is used (third embodiment) or where blind bores are used (fourth embodiment), the number of rods could be odd or even.

A first loop member 26 (FIG. 1) is loosely received within a first throughbore which is positioned between said first end 11 and second end 13 of post 12 and a second loop member 32 is loosely received within a second throughbore which is formed in said post near said second end 13. The first and second throughbores are not numbered in FIG. 1 because the drawing is small.

First loop member 26 is secured to a halyard 36 so that raising a halyard raises apparatus 10. As mentioned above, apparatus 10 is inverted, relative to its FIG. 1 configuration, as it is being raised toward the top of mast 40.

Second loop member 32 is secured to a downhaul line 38. When apparatus 10 nears the top of mast 40, downhaul line 38 is pulled downwardly and such pulling inverts apparatus 10 into its upstanding, operative configuration as depicted in FIG. 1. The flexibility and resilience of the post and the radial rods, coupled with the downhaul, permit the novel device to be worked around the standing rigging, shrouds and spreaders of the masthead until the device is fully raised. When fully deployed, the upper end of post 12 and the plurality of rods that radiate therefrom are positioned above the upper end of the mast or assorted wind-indicating devices. In the claims that follow, reciting the post and rods as being disposed above the upper end of the mast shall be construed as also describing the post and rods as being positioned above such assorted wind-indicating devices. This claim construction is required because birds often land atop such wind-indicating devices as well, and the novel device defeats such landing attempts.

This invention represents an important breakthrough in the art of bird anti-landing devices. The claims that follow recite a pioneering invention and are therefore entitled, as a matter of law, to broad interpretation to protect the heart or essence of the invention from piracy.

It will thus be seen that the objects set forth above, and those made apparent from the foregoing description, are efficiently attained. Since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An apparatus that prevents birds from landing atop a boat mast, comprising:

a post having a first end and a second end;

rod-mounting means positioned at said first end of said post for mounting a plurality of rods in radial relation to a longitudinal axis of said post;

said first end of said post having an operable position adjacent an upper end of said mast;

said plurality of rods being disposed in landing-interfering relation to said top of said mast so that birds cannot land atop said mast.

2. The apparatus of claim 1, further comprising:

a plurality of throughbores formed in said post near said first end;

one rod of said plurality of rods extending through each throughbore of said plurality of throughbores; and each rod being held in each throughbore about mid-length thereof so that substantially equal lengths of each rod are disposed in radial relation to said post on opposite sides thereof.

3. The apparatus of claim 2, wherein each of said rods is made of a slightly compressible material and has a circular cross section and wherein each of said throughbores has a common uniform internal diameter slightly less than a common external diameter of said rods so that each of said rods is held in its associated throughbore by a press fit.

4. The apparatus of claim 2, wherein each of said rods is made of a slightly compressible material and has a circular cross section and wherein each of said throughbores has a frusto-conical configuration where a large end thereof has a diameter greater than a common external diameter of said rods and where a small end thereof has a diameter that is slightly less than a common external diameter of said rods so that each of said rods is held in its associated throughbore by a press fit.

5. The apparatus of claim 2, wherein each of said rods is made of a straight, flexible and resilient material.

6. The apparatus of claim 1, further comprising a first attachment means for securing said post to a halyard so that raising the apparatus with said halyard raises said post to its operable position.

7. The apparatus of claim 6, wherein said first attachment means is a loop member having a first end that loosely extends through a throughbore formed in said post at a preselected location between its first and second ends and having a second end secured to said halyard for conjoint movement therewith.

8. The apparatus of claim 7, further comprising a second attachment means adapted to secure said second end of said post to a downhaul line.

9. The apparatus of claim 8, wherein said second attachment means is a loop member having a first end that loosely extends through a throughbore formed in said post adjacent said second end of said post and having a second end adapted to be secured to said downhaul line;

whereby said apparatus is raised in an inverted configuration by said halyard and whereby pulling on said downhaul line works the apparatus around obstacles and when said apparatus is fully raised to its operable position, pulling said downhaul line inverts said apparatus to its operable configuration.

10. The apparatus of claim 1, wherein respective outermost ends of said rods are circumferentially spaced apart from one another.

11. The apparatus of claim 10, wherein said respective outermost ends of said rods are substantially equidistantly spaced apart from one another.

12. The apparatus of claim 1, wherein said rod-mounting means includes a hub member secured to said first end of said post, said hub member having a plurality of radially disposed bores formed therein and each of said radially disposed bores securely receiving therewithin a radially innermost end of a rod.

13. The apparatus of claim 1, wherein said rod-mounting means includes a plurality of radially disposed blind bores formed in said first end of said post, each of said radially disposed blind bores securely receiving therewithin a radially innermost end of a rod.

14. The apparatus of claim 1, wherein said plurality of radially disposed bores is an odd or even number.

* * * * *